US006291925B1

(12) United States Patent
Jacobson

(10) Patent No.: US 6,291,925 B1
(45) Date of Patent: Sep. 18, 2001

(54) APPARATUS AND METHODS FOR REVERSIBLE IMAGING OF NONEMISSIVE DISPLAY SYSTEMS

(75) Inventor: Joseph M. Jacobson, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/113,681

(22) Filed: Jul. 10, 1998

Related U.S. Application Data

(60) Provisional application No. 60/071,169, filed on Jan. 12, 1998.

(51) Int. Cl.[7] ..... G09F 9/30
(52) U.S. Cl. ..... 310/319; 310/318
(58) Field of Search ..... 310/318, 319

(56) References Cited

U.S. PATENT DOCUMENTS

| | | | | |
|---|---|---|---|---|
| 3,590,315 | * | 6/1971 | Hoff et al. | 315/163 |
| 3,591,939 | | 7/1971 | Payne et al. | 40/28 |
| 3,689,781 | | 9/1972 | Kawada | 310/8.1 |
| 3,694,674 | | 9/1972 | Inoue | 310/8.2 |
| 3,736,446 | | 5/1973 | Berlincourt et al. | 310/8 |
| 3,790,826 | * | 2/1974 | Kawada | 310/318 |
| 3,796,897 | * | 3/1974 | Sakurai | 310/318 |
| 4,046,456 | | 9/1977 | Bonne | 350/160 |
| 5,365,141 | | 11/1994 | Kawai et al. | 310/359 |
| 5,371,430 | | 12/1994 | Sato et al. | 310/359 |
| 5,389,945 | | 2/1995 | Sheridon | 345/85 |
| 5,394,048 | | 2/1995 | Yamashita et al. | 310/316 |
| 5,463,266 | | 10/1995 | Fukouka et al. | 310/359 |
| 5,576,590 | | 11/1996 | Ohnishi et al. | 310/359 |
| 5,701,049 | | 12/1997 | Kanayama et al. | 310/359 |

FOREIGN PATENT DOCUMENTS

| | | | | |
|---|---|---|---|---|
| 0186519 | | 2/1986 | (EP) | G09F/9/30 |
| 0 929 063 A | * | 7/1999 | (EP) | 310/318 |
| WO93/06585 | | 1/1993 | (WO) | G09G/3/34 |

OTHER PUBLICATIONS

Chiang et al., "A stylus writable electrophoretic display device", SID International Symposium Digest of Technical Papers, May 1979 (1970–05), pp. 44–45, XP002102514.

* cited by examiner

*Primary Examiner*—Thomas M. Dougherty
(74) *Attorney, Agent, or Firm*—Testa, Hurwitz & Thibeault, LLP

(57) ABSTRACT

A writing head capable of rapidly and efficiently generating high field gradients while remaining amenable to low-voltage control utilizes a piezoelectric or Rosen transformer. A one- or two-dimensional array of such writing heads may be used to address a substrate bearing an arrangement of electrically responsive, nonemissive display elements, applying an image pattern thereto. Similarly, the array of writing heads can be used to remove an image, returning the substrate to its original, unimaged state.

16 Claims, 4 Drawing Sheets

APPARATUS AND METHODS FOR REVERSIBLE IMAGING OF NONEMISSIVE DISPLAY SYSTEMS

This application claims priority from U.S. Provisional Application Serial No. 60/071,169, filed Jan. 12, 1998.

FIELD OF THE INVENTION

The present invention relates to nonemissive display and information-bearing elements, and in particular to methods and apparatus for creating patterns and images in arrays of such elements.

BACKGROUND OF THE INVENTION

Nonemissive displays convey information using contrast differences, which are achieved by varying the reflectance or transmission of light; they are thus distinct from traditional emissive displays, which stimulate the eye by emitting light. One type of nonemissive display is an electrophoretic display, which utilizes the phenomenon of electrophoresis to achieve contrast. Electrophoresis refers to movement of charged particles in an applied electric field. When electrophoresis occurs in a liquid, the particles move with a velocity determined primarily by the viscous drag experienced by the particles, their charge (either permanent or induced), and the magnitude of the applied field.

An electrophoretic display utilizes charged particles of one color suspended in a dielectric liquid medium of a different color (that is, light reflected by the particles) is absorbed by the liquid. The suspension is housed in a cell located between (or partly defined by) a pair of oppositely disposed electrodes, one of which is transparent. When the electrodes are operated to apply a DC or pulsed field across the medium, the particles migrate toward the electrode of opposite sign. The result is a visually observable color change. In particular, when a sufficient number of the particles reach the transparent electrode, their color dominates the display; if the particles are drawn to the other electrode, however, they are obscured by the color of the liquid medium, which dominates instead.

Ideally, the particles maintain a strong uniform charge throughout the lifetime of the device and move as rapidly as possible under the influence of a relatively small electric field. The "switching time" t of suspended particles located between two electrodes, i.e., the time required for the population of particles to migrate from one of the electrodes to the other, is given by $$t = \frac{6\pi d^2 \eta}{V \varepsilon \zeta}$$

where d is the spacing between electrodes, $\eta$ is the viscosity of the liquid medium, $\in$ is its dielectric constant, V is the potential difference between the electrodes, and $\zeta$ is the zeta potential of the particles. Thus, the system is usually selected to minimize t. For example, the spacing between electrodes is only as large as is necessary to ensure that the particles are completely obscured following migration away from the transparent electrode.

Useful electrophoretic displays are bistable: their state persists even after the activating electric field is removed. This is generally achieved via residual charge on the electrodes and van der Waals interactions between the particles and the walls of the electrophoretic cell. As disclosed in U.S. Ser. Nos. 08/738,260, 08/819,320 and 08/935,800, and PCT application Ser. No. US96/13469, the entire disclosures of which are hereby incorporated by reference, electrophoretic displays may be fabricated from discrete, microencapsulated electrophoretic 10 elements. This approach eliminates the effects of agglomeration on a scale larger than the size of the capsule, which preferably is sufficiently small to be individually unnoticeable. Thus, the capsules function in a manner similar to pixels (although typically they are not individually addressable); even if agglomeration occurs, its effect is confined to a very small area. Furthermore, by setting an upper limit to the possible size of an agglomeration—that is, by preventing accumulations larger than the particle content of a capsule—the bulk effects of diminished field responsiveness and vulnerability to gravity are likewise limited.

Electrophoretic displays in accordance with the '260 application are based on microcapsunes each having therein an electrophoretic composition of a dielectric fluid and a suspension of particles that visually contrast with the dielectric liquid and also exhibit surface charges. A pair of electrodes, at least one of which is visually transparent, covers opposite sides of a two-dimensional arrangement of such microcapsules. A potential difference between the two electrodes causes the particles to migrate toward one of the electrodes, thereby altering what is seen through the transparent electrode. When attracted to this electrode, the particles are visible and their color predominates; when they are attracted to the opposite electrode, however, the particles are obscured by the dielectric liquid.

This approach is well-suited to applications involving contiguous arrays of electrophoretic elements intended to change state in unison. More difficult are applications requiring imposition of a visible pattern by selective activation of elements in the array. Imaging, in this sense, requires the ability to selectively apply electric fields of small spatial extent and high magnitude. The dimensions of the field effectively determine the resolution of the applied pattern, while the field magnitude dictates the switching time of the display and, therefore, the speed at which imaging can occur. Of course, the imaging speed is also limited by the rate at which the field itself can be toggled between high and low states.

Printer-type applications capable of imaging, at realistic rates, substrates bearing a multitude of small electrophoretic display elements may require fields on he order of 1 V/$\mu$m. Generating such fields rapidly, and controlling them with conventional digital logic devices that operate at low voltages, represents a significant design challenge.

DESCRIPTION OF THE INVENTION

BRIEF SUMMARY OF THE INVENTION

In accordance with the invention, a writing head capable of rapidly and efficiently generating high field gradients while remaining amenable to low-voltage control utilizes a piezoelectric or Rosen transformer. A one- or two-dimensional array of such writing heads may be used to separately address a small portion of a substrate bearing an arrangement of electrically responsive, nonemissive microcapsule display elements, and to apply an image pattern thereto. Similarly, the array of writing heads can be used to remove an image, returning the substrate to its original, unimaged state. The microcapsule arrangement can be flat or curved; applied to such arrangements, the term "two-dimensional" herein refers to configurations that may be fully planar, distorted or curved, and does not exclude some third-dimensional thickness. The arrangement can involve packing the microcapsules against one another to form a planar display, dispersing the microcapsules in a transparent matrix, or forming cavities or voids within such a matrix that themselves constitute the microcapsules.

Thus, in accordance with a first aspect of the invention, an arrangement of nonemissive, bistable display elements are selectively addressed by at least one piezoelectric transformer, the output of which is rectified and scanned over the display elements to transfer a predetermined pattern to the display.

In a second aspect, the pattern is transferred by means of a charge receptor which may be, for example, associated with a rotating drum. An imagewise electrostatic charge pattern is established on the charge receptor, which passes the display elements so as to activate the display—i.e., alter its visual appearance—in accordance with the pattern. The charge receptor may comprise a photoconductor, the imagewise electrostatic pattern being established by depositing a substantially uniform charge over at least a portion of the receptor, and subsequently exposing the charged receptor to an image pattern so as to cancel the charge in accordance with the pattern.

In a third aspect, a piezoelectric transformer is used to sense a voltage rather than to generate an electric field; an array of such sensors may therefore operate as a scanner. In this way, an electrophotographic charge pattern can be sensed and replicated digitally. Indeed, the same sensor array can be alternatively employed in a write mode to apply, to a nonemissive display sheet, the very image just scanned.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1A:
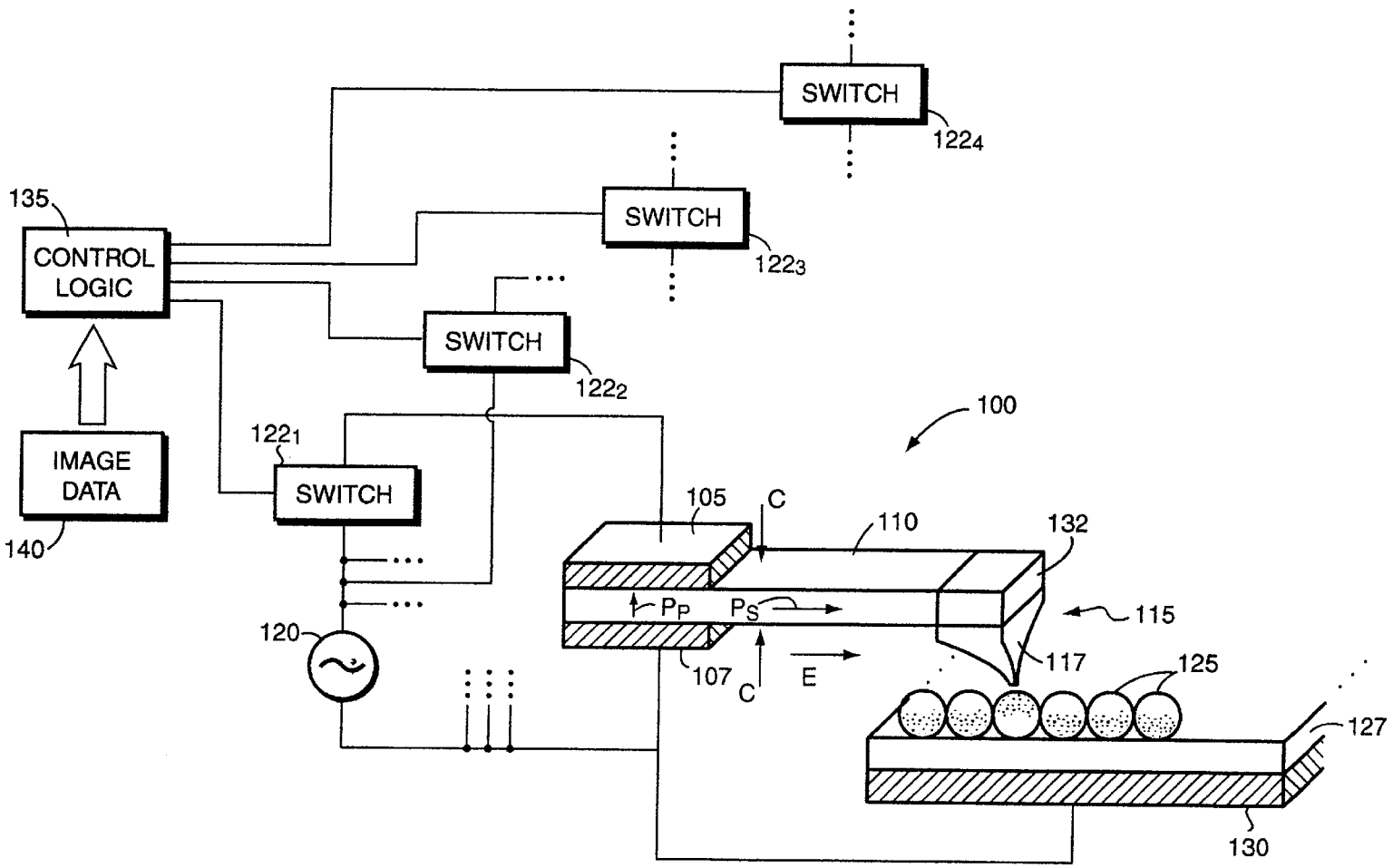
FIGS. 1A and 1B schematically illustrate an array of writing or sensing elements in accordance with the invention.

Refer first to FIG. A, which depicts the components of a multi-element writing head in accordance with the invention. One element, indicated generally at 100, is shown in greater detail and illustrates the mode of operation. First and second primary electrodes 105, 107 are disposed at one end, and on opposite faces, of a parallelpiped piezoelectric element 110. At least the portion of element 110 residing between electrodes 105, 107 is polarized along the thickness of the element, i.e., in the direction between the electrodes as indicated by the arrow $P_p$. A secondary electrode 115, shaped to terminate into a tip 117, is disposed on the other end of piezoelectric element 110. At least a portion of element 110 residing between secondary electrode 115 and the primary electrodes 105, 107 is polarized along the longitudinal extent of the element, as indicated by the arrow $P_s$ One terminal of an AC power source 120 is connected to primary electrode 107, and the other terminal of the power source is connected, via a low-voltage switch $\mathbf{122}_1$, to primary electrode 105.

When switch 122, is closed, power source 120 applies an AC voltage to piezoelectric element 110, stimulating mechanical vibration along the thickness of element 110—i.e., the axis passing through primary electrodes 105, 107—in the region between the primary electrodes. This vibration results in a complementary distortion along the length of element 110; for example, a rapid compression C in the region of primary electrodes 105, 107 induces a transitory longitudinal expansion E along the remainder of element 110 in accordance with Poisson's ratio. Owing to the longitudinal polarization between primary electrodes 105, 107 and secondary electrode 115, mechanical distortion along the length of piezoelectric 15 element 110 creates a voltage at secondary electrode 115. The magnitude of that voltage depends on the changes in length undergone by the longitudinally polarized segment as a result of transverse mechanical stimulation; those length changes depend, in turn, on the overall length of the longitudinally polarized segment, since mechanical force operating over a longer segment will induce a larger change in length. The frequency of the induced vibrations—and, hence, the frequency of the voltage observed at electrode 115—is the same as the driving frequency of power source 120; and if that frequency matches the resonant frequency of the piezoelectric element 110, the maximum voltage step-up at electrode 115 is obtained.

Writing-head element 100 may be used to image nonemissive display elements. As shown in FIG. 1A, a two-dimensional arrangement of microencapsulated electrophoretic display elements 125 is disposed on a substrate 127, which may be, for example, paper or plastic. Substrate 127 is itself disposed on an electrode 130 dimensionally contiguous (or substantially so) therewith. Application of an electric field across elements 125 causes the electrophoretic particles therein to migrate along the field in a direction determined by the sign of the particles' zeta potential. The tip 117 of electrode 115 is shaped to concentrate the field between electrode 115 and planar electrode 130 so that most of the field passes through one or a very few display elements 125. A field varying in polarity is clearly unsuitable for setting the optical state of an electrophoretic display; accordingly, electrode 115 contains a rectifier element 132 that restricts the voltage between electrodes 115, 130 to a single polarity.

The operation of writing-head element 100 is governed by a controller 135, which is capable of operating a plurality of writing-head elements by selective activation of their switches (representatively indicated at $\mathbf{122}_1$, $\mathbf{122}_2$, $\mathbf{122}_3$, $\mathbf{122}_4$). Controller 135 receives image data from a source 140 and controls the operation of switches 122 in accordance therewith. Switches 122 are low-voltage devices, such as transistors, that are actuated by conventional digital signals (generally about 5 V); ideally, the controlled voltage is of a similar order. Because of the high output voltages required of the transformer (on the order of 1 V/$\mu$m), however, achieving the necessary step-up from digital voltage levels may require special transformer designs such as, for example, using the multiple-stage approach described in U.S. Pat. No. 5,701,049, the entire disclosure of which is hereby incorporated by reference. Source 140 may be a computer, a scanner, or other device generating and/or storing image data.

Figure 1B:
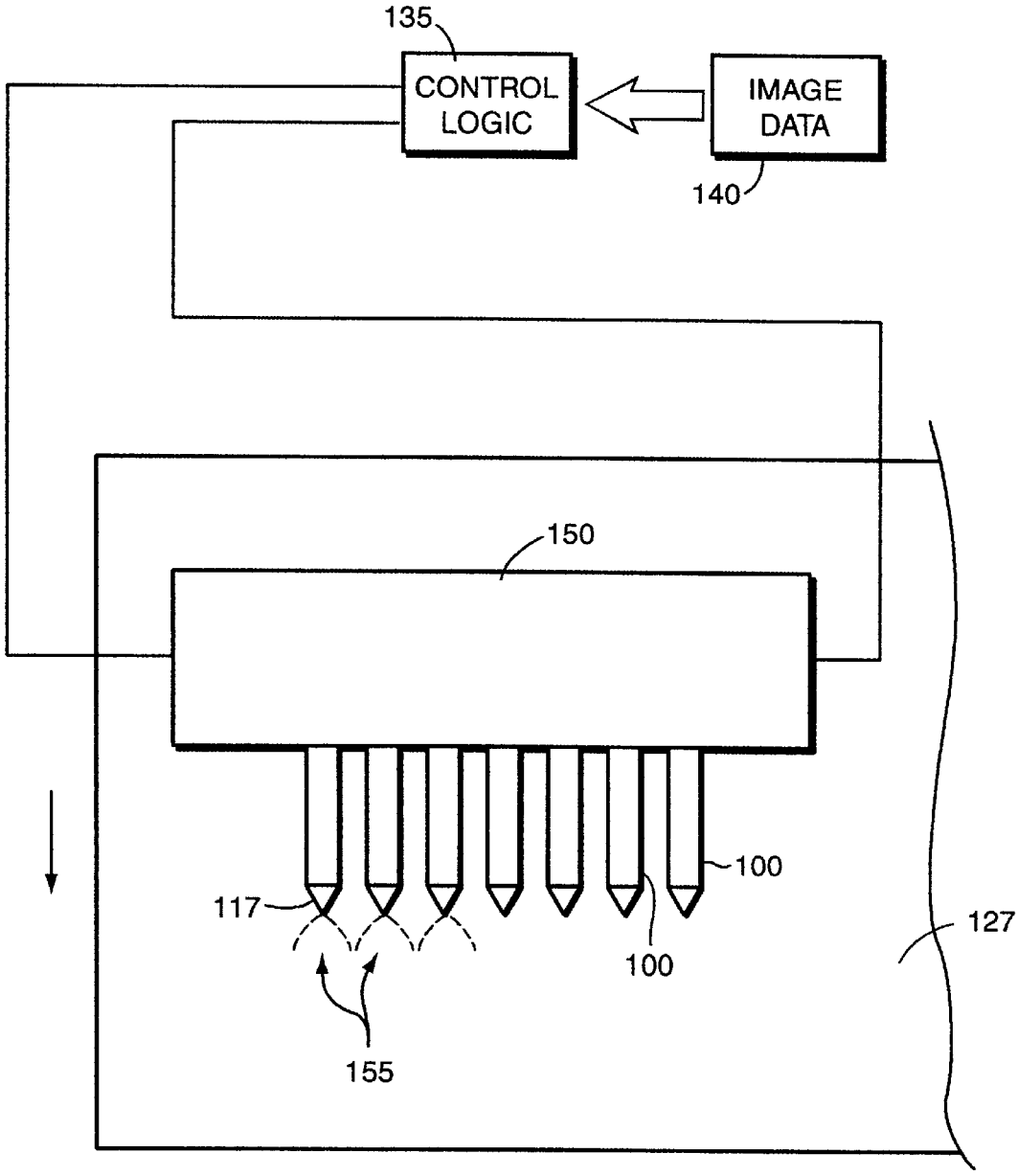

FIG. 1B illustrates this operation in greater detail. A writing head 150 includes a row of elements 100 as described above, all controlled by the controller 135. Writing head 150 is positioned adjacent to the substrate 127, which is coated with electrophoretic elements 125 (not shown in FIG. 1B), and relative motion is caused to occur between writing head 150 and substrate 127. For example, substrate 127 may be affixed to a drum that serves as electrode 130, and which rotates past writing head 150. The drum may be equipped with an angular encoder that registers movement of the drum.

Controller 135 keeps track of the position of writing head 150 (and, hence, each of the elements 100) relative to substrate 127, e.g., by means of signals received from the angular encoder. At the same time, controller 135 receives from source 140 data representative of the image to be applied to substrate 127. The image data is typically in a rasterized or "bitmap" format; each location in the bitmap corresponds to an imageable location on substrate 127, and the contents of each bitmap location determine whether the corresponding point on substrate 127 is to be "imaged"—i.e., to receive an imaging pulse that alters the optical state of the electrophoretic element(s) at that point-or to remain unchanged. Controller 135 coordinates the bitmap data with the instantaneous relative positions of elements 100 as writing head 150 scans over substrate 127, actuating the various elements 100 at appropriate times to reproduce the image onto substrate 127. Suitable circuitry for implementing these functions is conventional in the scanning, plotting, and printing arts.

If elements 100 are spaced closely enough together, the fringing fields 155 emanating from the associated electrode tips 117 spread sufficiently to cover the space between the electrode tips; the resolution of the writing head, in this case, corresponds to the inter-electrode spacing. If writing head 150 extends across the entirety of substrate 127, only a single pass thereover is necessary. Otherwise, writing head 150 passes over substrate 127 multiple times, and is indexed after each pass.

The maximum speed of relative motion between writing head 150 and substrate 127 depends on the switching time of the electrophoretic material, given the magnitude of the imposed electric field, and the frequency of the driving voltage applied to the electrodes. The applied voltage must reach its maximum level while the electrode tip remains adjacent to an image point, and must also decay to a non-imaging level before the electrode reaches the next image location.

If a resolution finer than the inter-electrode spacing is desired, it is possible to utilize multiple, staggered rows of elements 100, all controlled by the same controller. In effect, each row of writing elements scans over a different series of laterally offset image columns. Indeed, it is possible to go still further, utilizing a non-moving, two-dimensional array of writing elements. In this way, an image can be "stamped" onto a substrate by activating the elements in an imagewise pattern and bringing the element array into proximity with substrate 127. Conversely, the writing head may consist of as few as one electrode, e.g., contained within a handheld wand that may be wiped over the nonemissive display.

It should also be noted that one may dispense with electrode 130 by utilizing complementary electrodes, each of which is connected in the manner of electrode 130 and positioned proximate each electrode 115. So long as the spacing between electrode 115 and its electrode is sufficiently small, the field therebetween can be used to draw electrophoretic particles display elements 125 toward the electrodes in an imagewise fashion. In this case, the resolution is determined by the spacing between the individual electrodes 115, and between each electrode 115 and its complementary electrode.

Figure 2:
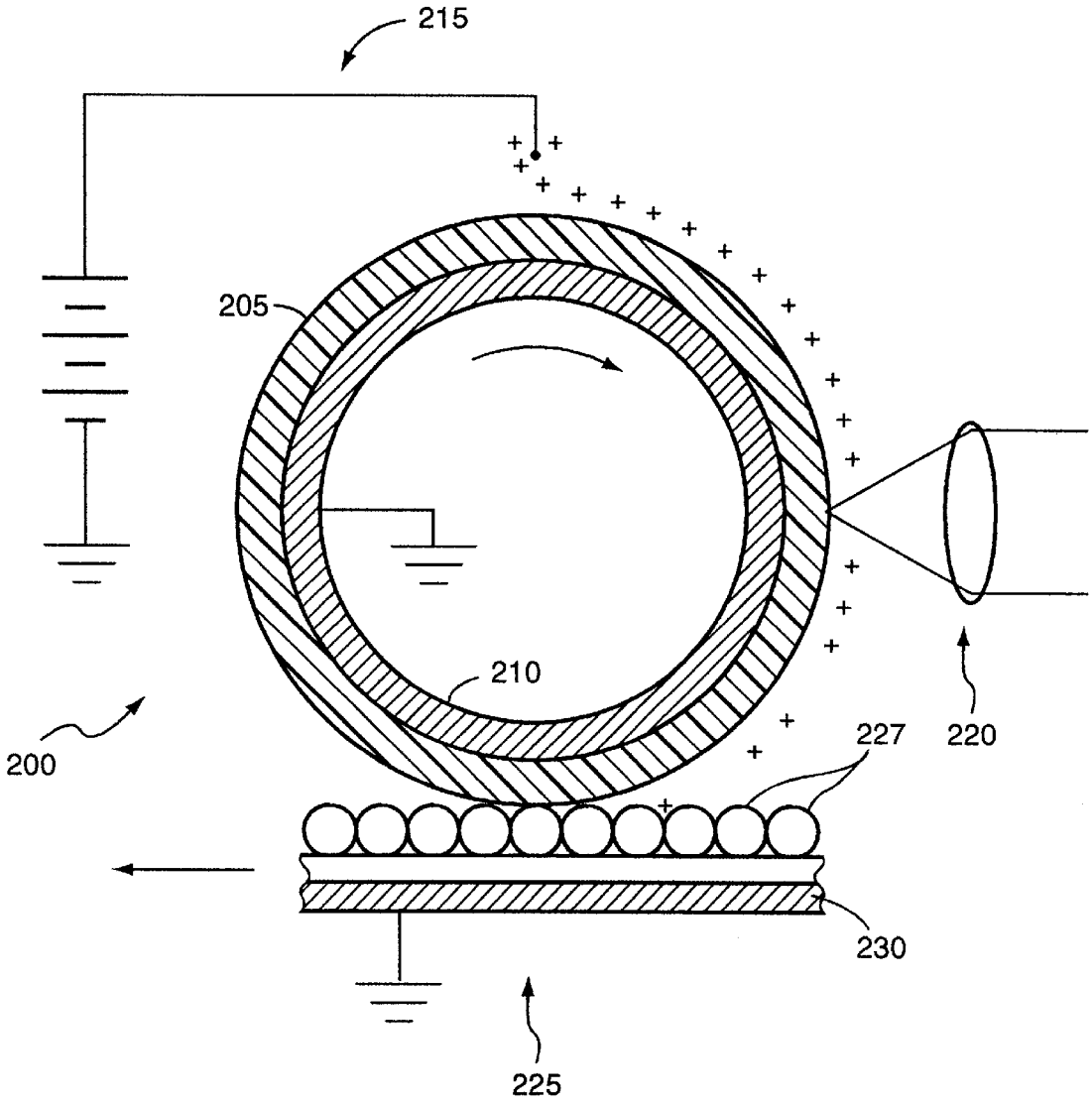
FIG. 2 schematically illustrates an electrophotographic application of the Invention.

Refer now to FIG. 2, which illustrates a reversible, electrophotographic application of the present invention. A rotating drum 200 includes a photoconductive surface layer 205 and a grounded metallic backing 210. Photoconductive layer 205 is a conventional electrophotographic material that is an insulator in the dark but becomes capable of conducting electric current when exposed to light. A charging element 215, such as a corona device, applies a positive (as shown in the figure) or negative charge to photoconductive surface 205, which induces an equal and opposite charge at the interface between layers 205, 210. The charge is of sufficient overall magnitude (e.g., 1000 V) to facilitate operation as discussed below.

An imaging element 220, located (rotationally) downstream of charging element 215, optically focuses an image to be reproduced onto photoconductive surface 205. A substrate 225 to be imaged includes an arrangement of nonemissive display elements 227, which are disposed on a grounding plane 230. Substrate 227 translates at a linear velocity equal to the peripheral velocity of the rotating drum 200, so the surfaces of substrate 227 and drum 200 pass each other at the same speed; for example, the surfaces may be in rolling contact.

In operation, the reflection of an image to be applied to drum 200 is focused onto surface 205 by imaging element 220, scanning along the rotating surface to produce thereon an electrostatic charge replica of the image on surface 205. The electric field between the charged surface 205 and ground plane 225 reaches its maximum level when the surfaces are closest to each other. Accordingly, as segments of the charge pattern rotate into adjacency with substrate 225, they alter the visual appearance of display elements 227 in accordance with that pattern. The magnitude of the applied charge, the velocity of drum 200 and substrate 225, and the switching time of the nonemissive display elements 227 are matched so that the image is effectively transferred at an acceptable rate. The image may be erased by applying an opposite charge to the entire surface of substrate 225, and re-imaged in the manner described above.

Figure 3A:
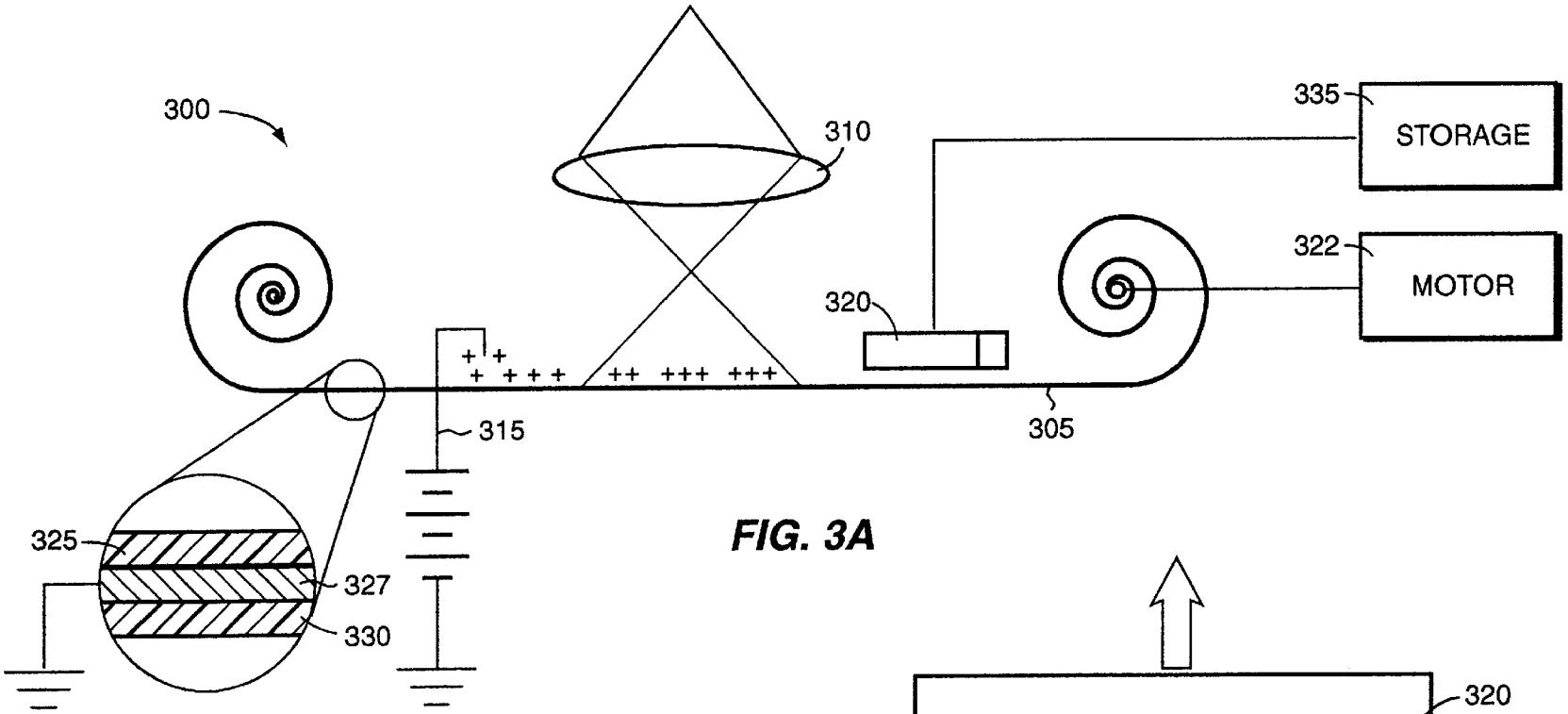
FIG. 3A schematically illustrates a hybrid digital camera utilizing the principles of the invention.
Figure 3B:
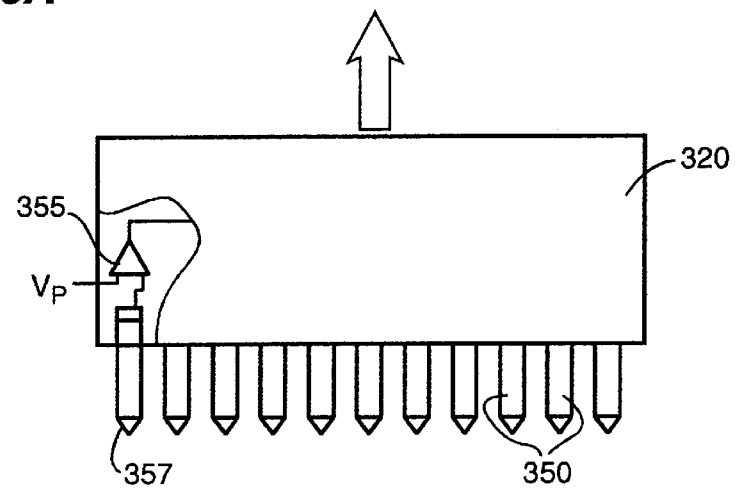
FIG. 3B is a partial cutaway view of a charge detector that utilizes piezoelectric transformers.

An array of piezoelectric transformers may also be used as a scanner to detect patterns of charge deposition. FIGS. 3A and 3B illustrate an application of this approach in a high-speed electronic camera. The camera 300 includes a roll of photoconductive film 305, an optical imaging element 310, a charging element, and a reader 320. A motor 322 advances the film 305 past imaging element 310.

Photoconductive film 305 is a three-layer structure that includes a photoconductive surface layer 325, a grounded metallic layer 327, and an insulating layer 330. As film 305 is advanced, charging element 315 applies a positive (as shown in the figure) or negative charge to photoconductive surface 325, which induces an equal and opposite charge at the interface between layers 325, 330. Imaging element 310 optically focuses the image to be recorded onto photoconductive surface 325, creating a charge replica of the image on surface 325. As film 305 moves past reader 320, the reader detects the charge pattern and records it in a computer storage device, which may comprise a volatile computer memory and/or a nonvolatile mass storage device such as a miniature hard disk.

It is not necessary, however, for reader 320 to scan each picture immediately after it is recorded and film 305 advanced. Because of insulating layer 330, the patterns of successive charge "pictures" remain undisturbed on layer 325 notwithstanding advancement and re-rolling of film 305. Consequently, the images may be recorded and film 305 advanced at high speed, with reader 320 retracted or simply inactive. At the photographer's convenience, film 305 is wound in the reverse direction at the normal operating speed of reader 320, so that recorded images are read and successively stored in storage 335. The charge patterns are removed from film 305 by applying an opposite charge to the entire surface of photoconductive layer 325 as it is re-rolled in the opposite direction.

The details of a suitable scanning device are shown in FIG. 3B. Each of a linear (or other) array of charge-detecting elements 350 includes a piezoelectric transformer as shown in FIG. 1A. Instead of being driven by an AC power supply, however, a primary electrode of each transformer are instead connected to a comparator, representatively shown at 355, and the other primary electrode is grounded. The transformer is thus used to step down the potential on layer 325 sensed by electrode tips 357 to a voltage level suitable for the digital comparator device 355 (see, e.g., Miyauchi et al., "Step-down transformer utilizing the piezoelectric transversal effect," *Transactions of the Institute of Electronics, Information and Communication Engineers A*, J80-A: 1699–1704, the entire disclosure of which is hereby incorporated by reference). The stepped-down sensed voltage is compared against a reference voltage $V_r$ corresponding to the minimum sensed (stepped-down) voltage that would be produced by a deposited charge. A clock circuit (not shown) places and locks the output voltages of the comparators onto an output bus, for transmission to storage 335, at preset intervals. The frequency of the clock circuit determines the longitudinal resolution of scanner 300.

The lateral resolution of the scanner 300 depends, once again, on the proximity of the detecting elements 350. These may, therefore, be arranged in multiple staggered rows to improve resolution.

It should be noted that each charge pattern can be viewed as an image by placing it into proximity with a sheet bearing an arrangement of nonemissive display elements as previously described. Alternatively, the stored images can be applied by elements 350, with transformers configured to switchably connect to an AC power supply in accordance with the configuration shown in FIG. 1A, so that the elements 350 behave as writing elements.

It will therefore be seen that the foregoing approaches to reversible image generation and recording are both versatile in application and conveniently practiced using conventional digital circuitry. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for selectively addressing an arrangement of nonemissive, bistable display elements, the display elements undergoing a visual response in reaction to an activation voltage applied thereto, the visual response persisting notwithstanding removal of the activation voltage, the apparatus comprising:

a. at least one piezoelectric transformer producing an output;

b. means for operating the at least one piezoelectric transformer to produce the activation voltage at its output, said means including an AC power supply having maximum output voltage level smaller than the activation voltage;

c. means for rectifying the output of the transformer; and d. means for selectively exposing, in a predetermined pattern, the display elements to the transformer output to transfer the pattern to the display.

2. The apparatus of claim 1 wherein the at least one piezoelectric transformer includes an output electrode, the means for selectively exposing the display elements including means for selectably causing the at least one piezoelectric transformer to produce the activation voltage such that, with the output electrode of the at least one piezoelectric transformer scanning over the display, the at least one piezoelectric transformer produces the activation voltage in accordance with data representing the pattern.

3. The apparatus of claim 1 comprising a plurality of piezoelectric transformers, each piezoelectric transformer having an output electrode associated therewith, the means for selectively exposing the display elements comprising a controller responsive to data representing the pattern and to a changeable position of each output electrode relative to the arrangement of display elements, the controller selectively causing each piezoelectric transformer to produce the activation voltage such that, with the output electrodes scanning over the display, the pattern is transferred to the display.

4. The apparatus of claim 3 wherein the output electrodes are arranged in a linear row.

5. The apparatus of claim 3 wherein the output electrodes are arranged in a plurality of parallel rows, the output electrodes being staggered relative to each other.

6. The apparatus of claim 3 wherein the output electrodes are arranged in a two-dimensional grid.

7. The apparatus of claim 1 wherein the activation voltage is at least 1 V/$\mu$m.

8. The apparatus of claim 1 further comprising means for alternatively operating the at least one piezoelectric transformer to sense a charge on a substrate and to produce a stepped-down output corresponding thereto.

9. The apparatus of claim 8 further comprising means for receiving the stepped-down output and storing a digital representation of the corresponding sensed charges.

10. A method of selectively addressing an arrangement of nonemissive, bistable display elements, the display elements undergoing a visual response in reaction to an activation voltage applied thereto, the visual response persisting notwithstanding removal of the activation voltage, the method comprising the steps of:

a. providing at least one piezoelectric transformer producing an output;

b. operating the at least one piezoelectric transformer to selectively produce the activation voltage as its output in accordance with a predetermined pattern;

c. rectifying the output; and d. scanning the selectively produced output over the display elements to transfer the pattern to the display.

11. The method of claim 10 wherein the operating step is performed by applying a time-varying voltage to the piezoelectric transformer, the time-varying voltage being smaller than the activation voltage.

12. The method of claim 10 wherein a plurality of piezoelectric transformers are provided, each piezoelectric transformer having an output electrode associated therewith, the scanning step comprising selectively exposing the display elements to the activation voltage in accordance with digital data representing the pattern.

13. The method of claim 12 wherein the output electrodes are arranged in a linear row.

14. The method of claim 12 wherein the output electrodes are arranged in a plurality of parallel rows, the output electrodes being staggered relative to each other.

15. The method of claim 12 wherein the output electrodes are arranged in a two-dimensional grid.

16. The method of claim 10 wherein the activation voltage is at least 1 V/$\mu$m.

* * * * *